US010519532B2

(12) United States Patent
Samusawa et al.

(10) Patent No.: US 10,519,532 B2
(45) Date of Patent: Dec. 31, 2019

(54) STEEL MATERIAL HAVING EXCELLENT ALCOHOL-INDUCED PITTING CORROSION RESISTANCE AND ALCOHOL-INDUCED SCC RESISTANCE

(71) Applicant: JFE STEEL CORPORATION, Tokyo (JP)

(72) Inventors: Itaru Samusawa, Tokyo (JP); Kazuhiko Shiotani, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 478 days.

(21) Appl. No.: 15/031,792

(22) PCT Filed: Dec. 5, 2014

(86) PCT No.: PCT/JP2014/006095

§ 371 (c)(1),
(2) Date: Apr. 25, 2016

(87) PCT Pub. No.: WO2015/087529

PCT Pub. Date: Jun. 18, 2015

(65) Prior Publication Data

US 2016/0244866 A1 Aug. 25, 2016

(30) Foreign Application Priority Data

Dec. 12, 2013 (JP) ..... 2013-257386
Aug. 18, 2014 (JP) ..... 2014-166024

(51) Int. Cl.

| | |
|---|---|
| ***C22C 38/00*** | (2006.01) |
| ***C22C 38/60*** | (2006.01) |
| ***C22C 38/04*** | (2006.01) |
| ***C22C 38/02*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| *C21D 8/02* | (2006.01) |

(52) U.S. Cl.

CPC ..... *C22C 38/60* (2013.01); *C22C 38/00* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C21D 8/0226* (2013.01); *C21D 8/0263* (2013.01)

(58) Field of Classification Search

CPC ..... C22C 38/00

See application file for complete search history.

(56) References Cited

U.S. PATENT DOCUMENTS

| | | | | |
|---|---|---|---|---|
| 5,372,654 | A * | 12/1994 | Satoh | C21D 8/0457 148/217 |
| 2005/0016636 | A1 | 1/2005 | Kobayashi et al. | |
| 2013/0061989 | A1* | 3/2013 | Nakamura | C21D 8/0226 148/602 |
| 2013/0295410 | A1* | 11/2013 | Takahashi | C21D 8/0226 428/659 |
| 2014/0069619 | A1 | 3/2014 | Hiraide et al. | |

FOREIGN PATENT DOCUMENTS

| | | | |
|---|---|---|---|
| CN | 102703812 | A | 10/2012 |
| JP | S61-19769 | A | 1/1986 |
| JP | 2003-221653 | A | 8/2003 |
| JP | 2010-185108 | A | 8/2010 |
| JP | 2011-026669 | A | 2/2011 |
| JP | 2011-231358 | A | 11/2011 |
| JP | 2012-214881 | A | 11/2012 |
| JP | 2013-129904 | A | 7/2013 |
| JP | 2013-227610 | A | 11/2013 |
| JP | 2014-111806 | A | 6/2014 |
| JP | 2014-111807 | A | 6/2014 |

OTHER PUBLICATIONS

Gui et al., "Evaluation of Ammonia Hydroxide for Mitigating Stress Corrosion Cracking of Carbon Steel in Fuel Grade Ethanol," NACE International Corrosion 2011 Conference & Expo, Paper 11138, 2011.

Mar. 3, 2015 International Search Report issued in International Patent Application No. PCT/JP2014/006095.

Dec. 5, 2016 Office Action issued in Chinese Patent Application No. 201480063928.2.

* cited by examiner

*Primary Examiner* — Erin B Saad

(74) *Attorney, Agent, or Firm* — Oliff PLC

(57) ABSTRACT

A steel material of the disclosure has a chemical composition containing, in mass %: 0.03% to 0.3% C; 0.03% to 1.0% Si; 0.1% to 2.0% Mn; 0.003% to 0.03% P; 0.005% or less S; 0.005% to 0.1% Al; 0.005% to 0.5% Cu; 0.01% to 0.5% Sb; and 0.005% to 0.5% Ni, with a balance being Fe and incidental impurities. Thus, the steel material has excellent alcohol-induced pitting corrosion resistance and alcohol-induced SCC resistance, and can be used for large structures with no need for coating, inhibitor addition, or the like by improving the pitting corrosion resistance and SCC resistance of the steel material itself.

5 Claims, No Drawings

STEEL MATERIAL HAVING EXCELLENT ALCOHOL-INDUCED PITTING CORROSION RESISTANCE AND ALCOHOL-INDUCED SCC RESISTANCE

TECHNICAL FIELD

The disclosure relates to a steel material having excellent alcohol-induced corrosion resistance, in particular excellent alcohol-induced pitting corrosion resistance and alcohol-induced SCC resistance.

The disclosure especially relates to a steel material having excellent alcohol-induced pitting corrosion resistance and alcohol-induced SCC resistance suitable for use in parts that come into direct contact with bioalcohol, such as a steel material used in tanks for storing bioalcohols, e.g. bioethanol, vessel tanks for transporting bioalcohols, and tanks for automobiles or a steel material used for pipeline transport.

BACKGROUND

Bioethanol as an example of bioalcohols is produced mainly by decomposing and purifying sugar in corn, wheat, etc. Bioethanol has been widely used throughout the world in recent years, as an alternative fuel to petroleum (gasoline) or as a fuel mixed with gasoline. The usage of bioethanol is thus increasing every year.

However, despite an increase in handling of bioethanol in processes such as storing and transporting bioethanol or mixing bioethanol with gasoline, the high local corrosiveness of bioethanol, in particular its property of causing pitting corrosion and stress corrosion cracking (SCC), makes the handling of bioethanol difficult.

The high corrosiveness of bioethanol is due in part to the presence of acetic acid or chloride ions as infinitesimal impurities in the bioethanol production process or the absorption of water or dissolved oxygen during storage.

There is thus a drawback in that bioethanol can be safely handled only in facilities with ethanol resistance measures, e.g. facilities using organic coating materials, stainless steel, or stainless clad steel having excellent ethanol-induced SCC resistance, as bioethanol storage facilities. Besides, conventional pipelines for transporting petroleum, etc., cannot be used for transportation of bioethanol.

Hence, a problem lies in that facilities for handling bioethanol require considerable cost.

To solve the aforementioned problem, Patent Literature (PTL) 1 as an example proposes a method of applying a zinc-nickel coating containing 5% to 25% Ni to a steel material for tanks for biofuels, and performing a chemical conversion treatment containing no hexavalent chromium on the coating. This method is described to achieve favorable corrosion resistance in ethanol-containing gasoline.

PTL 2 proposes a steel sheet for pipes having excellent corrosion resistance by applying a "Zn—Co—Mo coating where the composition ratio of Co to Zn in the coating layer is 0.2 at % to 4.0 at %" to the steel sheet surface, for fuel vapor of bioethanol and the like.

Non-patent Literature (NPL) 1 investigates the inhibitor effect of ammonium hydroxide against stress corrosion cracking (SCC) of a steel material in a bioethanol simulated liquid. NPL 1 reports that the addition of ammonium hydroxide suppresses crack growth and mitigates SCC.

CITATION LIST

Patent Literatures

PTL 1: JP 2011-026669 A
PTL 2: JP 2011-231358 A

Non-Patent Literatures

NPL 1: F. Gui, J. A. Beavers and N. Sridhar, Evaluation of ammonia hydroxide for mitigating stress corrosion cracking of carbon steel in fuel grade ethanol, NACE Corrosion Paper, No. 11138 (2011)

SUMMARY

Technical Problem

The zinc-nickel coating disclosed in PTL 1 seems to be effective in improving corrosion resistance. However, such Zn—Ni coating requires electroplating. Accordingly, although the coating can be properly used for small structures such as fuel tanks for automobiles, the coating cannot be used for thick steel materials of large structures such as storage tanks of 1000 kL or more and line pipes, due to enormous treatment cost. Moreover, in the case where a coating failure or the like occurs, pitting corrosion and SCC in the part are rather facilitated. Thus, sufficient pitting corrosion resistance and SCC resistance are not achieved by the technique.

The Zn—Co—Mo coating disclosed in PTL 2 requires electroplating, too, and so cannot be used for thick steel materials of large structures for the same reason as PTL 1. For the same reason as PTL 1, sufficient pitting corrosion resistance and SCC resistance are not achieved by the technique.

The addition of the inhibitor in NPL 1 certainly mitigates corrosion phenomena such as SCC. However, its effect is not sufficient. While the inhibitor adsorbs on the surface to exhibit its effect, the adsorption behavior is significantly affected by the surrounding pH and the like, and the inhibitor may be unable to sufficiently adsorb on the surface if local corrosion occurs. There is also a risk of pollution by a spill of the inhibitor to the environment. Therefore, the technique cannot be regarded as a suitable measure against corrosion.

As described above, the anti-corrosion methods by coating are not suitable for large structures, and fail to produce sufficient effects for pitting corrosion resistance and SCC resistance. The inhibitor normally does not have sufficient effect in reducing corrosion, and there is also concern about its environmental impact. For applications to large structures, it is advantageous to improve the corrosion resistance of the steel material itself in bioethanol, in terms of cost as well.

It could therefore be helpful to provide a steel material having excellent alcohol-induced pitting corrosion resistance and alcohol-induced SCC resistance which can be used for large structures with no need for coating, inhibitor addition, or the like, by improving the corrosion resistance, in particular pitting corrosion resistance and SCC resistance, of the steel material itself.

Solution to Problem

To solve the stated problem, we made intensive studies on the corrosion phenomenon of the steel material in a bioethanol simulated liquid.

As a result, we discovered that adding Sb is effective in suppressing corrosion, in particular pitting corrosion and SCC, in bioethanol, and also reducing the S content suppresses pitting corrosion and SCC in bioethanol significantly.

We also discovered that, along with adding Sb and reducing S as mentioned above, actively adding Al and Cu enhances the corrosion resistance improvement effect of Sb and further suppresses pitting corrosion and SCC in bioethanol.

The disclosure is based on the aforementioned discoveries and further studies.

We thus provide the following.

1. A steel material having excellent alcohol-induced pitting corrosion resistance and alcohol-induced SCC resistance, the steel material having a chemical composition containing, in mass %:

0.03% to 0.3% C;
0.03% to 1.0% Si;
0.1% to 2.0% Mn;
0.003% to 0.03% P;
0.005% or less S;
0.005% to 0.1% Al;
0.005% to 0.5% Cu;
0.01% to 0.5% Sb; and
0.005% to 0.5% Ni,
with a balance being Fe and incidental impurities.

2. The steel material according to the foregoing 1, wherein the Sb content and the S content satisfy Sb/S≥15.

3. The steel material according to the foregoing 1 or 2, wherein the Ni content and the Cu content satisfy Ni/Cu≥0.2.

4. The steel material according to any one of the foregoing 1 to 3, wherein the chemical composition further contains, in mass %, one or two selected from:

0.01% to 0.5% Mo; and
0.01% to 0.5% W.

5. The steel material according to any one of the foregoing 1 to 4, wherein the chemical composition further contains, in mass %, 0.01% or less Ca.

6. The steel material according to any one of the foregoing 1 to 5, wherein the chemical composition further contains, in mass %, one or more selected from:

0.005% to 0.1% Nb;
0.005% to 0.1% Zr;
0.005% to 0.1% V; and
0.005% to 0.1% Ti.

Advantageous Effect

The disclosed steel material, when employed as a steel material for storage tanks or transport tanks for bioethanol or pipelines, can be used longer than conventional steel materials. Moreover, accidents caused by bioethanol leakage resulting from pitting corrosion or SCC can be avoided, and also these various facilities can be provided at low cost. The disclosed steel material is therefore very useful industrially.

DETAILED DESCRIPTION

The following describes one of the disclosed embodiments in detail.

The reasons for limiting the chemical composition of the steel material to the aforementioned range are described first. While the unit of the content of each element in the chemical composition of the steel material is "mass %," the unit is hereafter simply expressed by "%" unless otherwise specified.

C: 0.03% to 0.3%

C is an element necessary to ensure the strength of steel. The C content is at least 0.03%, in order to ensure target strength (400 MPa or more). If the C content exceeds 0.3%, weldability decreases and restrictions are placed on welding, and so the upper limit is 0.3%. The C content is preferably in the range of 0.03% to 0.2%.

Si: 0.03% to 1.0%

Si is added for deoxidation. If the Si content is less than 0.03%, the deoxidation effect is poor. If the Si content exceeds 1.0%, toughness and weldability decrease. The Si content is therefore in the range of 0.03% to 1.0%. The Si content is preferably in the range of 0.05% to 0.5%.

Mn: 0.1% to 2.0%

Mn is added to improve strength and toughness. If the Mn content is less than 0.1%, the effect is not sufficient. If the Mn content exceeds 2.0%, weldability decreases. The Mn content is therefore in the range of 0.1% to 2.0%. The Mn content is preferably in the range of 0.3% to 1.6%.

P: 0.003% to 0.03%

P is contained as an incidental impurity. Since P degrades toughness and weldability, the P content is limited to 0.03% or less. An excessively low P content, however, is disadvantageous in terms of dephosphorization cost, and so the lower limit is 0.003%. The P content is preferably in the range of 0.003% to 0.025%.

S: 0.005% or Less

S is an important element affecting the pitting corrosion resistance and SCC resistance of the disclosed steel material. S is typically contained as an incidental impurity. If the S content is high, not only the corrosion resistance decreases, but also an inclusion, such as MnS, serving as a SCC origin increases and the SCC resistance decreases. Such an inclusion also acts as a preferential anode site, facilitating pitting corrosion. Accordingly, the S content is desirably as low as possible. An S content of 0.005% or less is allowable. The S content is preferably 0.004% or less.

Al: 0.005% to 0.1%

Al not only functions as a deoxidizer, but also functions to further enhance the pitting corrosion resistance and SCC resistance improvement effect of Sb by coexisting with Cu. $Al^{3+}$ ions leaching with the anode dissolution of the base material undergo a hydrolysis reaction with water which is present in bioethanol in small amount. This decreases the pH at the anode site, as a result of which the formation of the below-mentioned Sb oxide is promoted to thus improve pitting corrosion resistance and SCC resistance.

If the Al content is less than 0.005%, insufficient deoxidation is likely to cause lower toughness, and also the pitting corrosion resistance and SCC resistance improvement effect of Sb cannot be enhanced sufficiently. If the Al content exceeds 0.1%, the toughness of the weld metal part in the case of welding decreases. The Al content is therefore in the range of 0.005% to 0.1%. In particular, the Al content is preferably in the range of 0.010% to 0.070%, to achieve both high toughness and high pitting corrosion resistance and SCC resistance. The Al content is more preferably in the range of 0.015% to 0.070%, and further preferably in the range of 0.020% to 0.070%.

Cu: 0.005% to 0.5%

Cu is an element that improves acid resistance, and is an element necessary for Al to develop the pitting corrosion resistance and SCC resistance improvement effect of Sb. Originally, the aforementioned decrease of pH at the anode site by Al facilitates the formation of the Sb oxide but also accelerates the corrosion reaction due to an increase in proton concentration, so that there is no improvement in pitting corrosion resistance and SCC resistance as a whole. However, the improvement of acid resistance by Cu suppresses the acceleration of corrosion due to the decrease of pH caused by the hydrolysis reaction of Al, as a result of which the enhancement of the pitting corrosion resistance and SCC resistance improvement effect of Sb by Al becomes more dominant. The pitting corrosion resistance and the SCC resistance are thus improved as a whole.

If the Cu content is less than 0.005%, the pitting corrosion resistance and SCC resistance improvement effect of Sb cannot be sufficiently enhanced by Al. If the Cu content exceeds 0.5%, manufacturing is subject to constraints. The Cu content is therefore in the range of 0.005% to 0.5%. The Cu content is preferably in the range of 0.01% to 0.3%.

Sb: 0.01% to 0.5%

Sb is an important element for enhancing pitting corrosion resistance and SCC resistance in the disclosed steel material, and is an element effective in improving pitting corrosion resistance and SCC resistance in an acid environment created by acetic acid contained in bioethanol as an impurity. In detail, with the anode dissolution of the base material, Sb remains and thickens at the anode site as an oxide. This protects the anode part and significantly suppresses the progress of the dissolution reaction, thus improving pitting corrosion resistance and SCC resistance. If the Sb content is less than 0.01%, the effect is poor. If the Sb content exceeds 0.5%, steel material manufacturing is subject to constraints. The Sb content is therefore in the range of 0.01% to 0.5%. The Sb content is preferably in the range of 0.02% to 0.30%.

Ni: 0.005% to 0.5%

Ni has an effect of preventing cracking caused by hot shortness in the continuous casting process or hot rolling process due to the addition of Cu. If the Ni content is less than 0.005%, the effect of preventing cracking caused by the addition of Cu cannot be achieved. Excessively adding Ni, however, is disadvantageous in terms of cost, and so the upper limit is 0.5%. The Ni content is preferably in the range of 0.008% to 0.3%.

Of the aforementioned components, the Sb and S contents and the Cu and Ni contents preferably satisfy the following respective relationships.

$Sb/S \geq 15$

As mentioned above, adding Sb and reducing S are effective in suppressing pitting corrosion and SCC in bioethanol. In particular, pitting corrosion resistance and SCC resistance can be further improved in the case where Sb/S is 15 or more. Therefore, Sb/S is preferably 15 or more. Sb/S is more preferably 20 or more. Excessively high Sb/S, however, leads to higher cost due to S reduction and Sb addition, and so Sb/S is preferably 500 or less. Sb/S is more preferably 300 or less.

$Ni/Cu \geq 0.2$

As mentioned above, Cu is an element necessary for Al to develop the pitting corrosion resistance and SCC resistance improvement effect of Sb. Meanwhile, adding Cu degrades the manufacturability of the steel material. This manufacturability degradation by Cu can be prevented by adding Ni. In particular, the effect is remarkable in the case where Ni/Cu is 0.2 or more. Therefore, Ni/Cu is preferably 0.2 or more. Ni/Cu is more preferably 0.3 or more. Excessively high Ni/Cu, however, leads to higher cost due to Ni addition, and so Ni/Cu is preferably 80 or less. Ni/Cu is more preferably 50 or less.

While the basic components have been described above, the disclosed steel material may further include the following other components according to need.

One or two types selected from: Mo: 0.01% to 0.5%; and W: 0.01% to 0.5%

Mo: 0.01% to 0.5%

Mo is an element effective in improving pitting corrosion resistance and SCC resistance. Mo forms oxysalt as a corrosion product. When a crack which serves as a SCC origin occurs, the corrosion product functions to immediately protect the crack tip and inhibit the growth of the crack. Mo also has an effect of, as a result of being incorporated into the oxide film on the surface of the steel material, improving the dissolution resistance of the oxide film in an acid environment created by acetic acid contained in bioethanol as an impurity, thus reducing non-uniform corrosion and also suppressing pitting corrosion. If the Mo content is less than 0.01%, the pitting corrosion resistance and SCC resistance improvement effect is poor. Meanwhile, a Mo content exceeding 0.5% is disadvantageous in terms of cost. Therefore, the Mo content is in the range of 0.01% to 0.5%. The Mo content is preferably in the range of 0.01% to 0.3% to avoid an increase in cost.

W: 0.01% to 0.5%

W is an element effective in improving pitting corrosion resistance and SCC resistance. As with Mo, W forms oxysalt as a corrosion product. When a crack which serves as a SCC origin occurs, the corrosion product functions to immediately protect the crack tip and inhibit the growth of the crack. W also has an effect of, as a result of being incorporated into the oxide film on the surface of the steel material, improving the dissolution resistance of the oxide film in an acid environment created by acetic acid contained in bioethanol as an impurity, thus reducing non-uniform corrosion and also suppressing pitting corrosion. If the W content is less than 0.01%, the pitting corrosion resistance and SCC resistance improvement effect is poor. Meanwhile, a W content exceeding 0.5% is disadvantageous in terms of cost. Therefore, the W content is in the range of 0.01% to 0.5%. The W content is preferably in the range of 0.01% to 0.3% to avoid an increase in cost.

Ca: 0.01% or Less

Ca is added to perform morphological control on precipitates of S (e.g. MnS) as incidental impurities and prevent cracking such as SCC. If Ca is added excessively, however, coarse inclusions are formed to degrade the toughness of the base material. Therefore, the Ca content is preferably 0.01% or less. Meanwhile, if the Ca content is less than 0.0005%, the effect of adding Ca is poor, and so the Ca content is preferably 0.0005% or more.

One or at least two types selected from: Nb: 0.005% to 0.1%; Zr: 0.005% to 0.1%; V: 0.005% to 0.1%; and Ti: 0.005% to 0.1%

One or at least two types selected from Nb, Zr, V, and Ti may be included to improve the mechanical properties of the steel material. Regarding each of these elements, the effect of the addition is poor if the content is less than 0.005%, and the mechanical properties of the weld decrease if the content exceeds 0.1%. Therefore, the content is in the range of 0.005% to 0.1%. The content is preferably in the range of 0.005% to 0.05%.

Components other than those described above may also be included in the disclosed steel material as long as its advantageous effects are not undermined. For example, a small amount of REM may be added as a deoxidizer in addition to the aforementioned components.

In the disclosed steel material, components other than those described above are Fe and incidental impurities.

A preferred method of manufacturing the disclosed steel material is described below.

Molten steel having the chemical composition described above is prepared by steelmaking in a known furnace such as a converter or an electric heating furnace, and made into a steel raw material such as slabs or billets by a known method such as continuous casting or ingot casting. Vacuum degassing refining or the like may be performed upon steelmaking.

The components of the molten steel may be adjusted according to a known steel refining method.

Next, when hot rolling the steel raw material into a desired dimension and shape, the steel raw material is heated to a temperature of 1000° C. to 1350° C. A heating temperature less than 1000° C. causes significant deformation resistance, making hot rolling difficult. A heating temperature exceeding 1350° C. may lead to surface flaws, or increase scale loss or the fuel consumption rate. The heating temperature is preferably in the range of 1050° C. to 1300° C. In the case where the temperature of the steel raw material is already in the range of 1000° C. to 1350° C., the steel raw material may be directly submitted to hot rolling without heating.

In hot rolling, the hot-rolling finisher delivery temperature needs to be optimized. The hot-rolling finisher delivery temperature is preferably 600° C. or more and 850° C. or less. If the hot-rolling finisher delivery temperature is less than 600° C., the rolling load increases due to an increase in deformation resistance, making rolling difficult. If the hot-rolling finisher delivery temperature exceeds 850° C., a desired strength may not be obtained. Cooling after finish hot rolling is preferably air cooling or accelerated cooling with a cooling rate of 150° C./s or less. In the case of accelerated cooling, the cooling stop temperature is preferably in the range of 300° C. to 750° C. Reheating treatment may be performed after cooling.

EXAMPLES

Examples according to the disclosure are described below. Note that the disclosure is not limited to these examples.

Molten steels having the respective chemical compositions shown in Table 1 were each prepared by steelmaking in a vacuum melting furnace or a converter and then made into slabs by continuous casting. The slabs were heated to 1230° C., and then hot-rolled under the condition of a hot-rolling finisher delivery temperature of 820° C. to form steel sheets with a thickness of 13 mm.

These steel sheets were subject to the following pitting corrosion test and SCC test.

(1) Pitting Corrosion Test using Bioethanol Simulated Liquid

Each steel material was cut to 10 mm×25 mm×3.5 mm t, and both surfaces were polish-finished with #2000 emery paper. The steel material was then subject to ultrasonic degreasing in acetone for 5 minutes, and air-dried to obtain a corrosion test material. A solution obtained by adding 10 ml water, 5 ml methanol, 560 mg acetic acid, and 132 mg NaCl to 985 ml ethanol was used as a bioethanol simulated liquid. The solution was put into a test tube, and the test material was immersed therein at room temperature. After immersed in the solution for 30 days, the test material was taken out and rust on its surface was rinsed using a sponge or the like. Following this, corrosion products were removed in an acid with an inhibitor added thereto. The test material was then washed with pure water, washed in ethanol, and air-dried. After this, the pitting corrosion depth on the surface of the test material was measured using a 3D laser microscope, and the maximum pitting corrosion depth was evaluated.

If the maximum pitting corrosion depth was less than 70% with respect to base steel (Comparative Example 1), the test material was evaluated as having excellent pitting corrosion resistance.

(2) SCC Test by Slow Strain Rate Testing (SSRT) in Bioethanol Simulated Liquid

Each steel material was formed into a round bar of 130 mm×6.35 mm φ. Both ends were wrenched off, and the round bar was processed so as to be 3.81 mm φ over the length of 12.7 mm from its center. The test material was subject to ultrasonic degreasing in acetone for 5 minutes, and then attached to a SSRT tester. A solution obtained by adding 10 ml water, 5 ml methanol, 56 mg acetic acid, and 52.8 mg NaCl to 985 ml ethanol was used as a bioethanol simulated liquid. A strain was applied at a strain rate of $2.54\times10^{-5}$ mm/s in a dry air atmosphere into the cells covering the test material under each of the condition of being filled with the bioethanol simulated liquid and the condition of not being filled with the bioethanol simulated liquid. The ratio of total elongation until fracturing ([(total elongation with the solution)/(total elongation without the solution)]×100(%)) was calculated, and SCC resistance was evaluated based on the following criteria.

Excellent: 95% or more

Good: 90% or more and less than 95%

Fair: 85% or more and less than 90%

Poor: less than 85%

The results are shown in Table 2.

TABLE 1

| | Chemical composition (mass %) | | | | | | | | | | | |
|---|---|---|---|---|---|---|---|---|---|---|---|---|
| No. | C | Mn | Si | P | S | Al | Cu | Sb | Ni | Mo | W | Ca |
| 1 | 0.08 | 0.89 | 0.22 | 0.011 | 0.0022 | 0.030 | 0.02 | 0.05 | 0.01 | — | — | — |
| 2 | 0.08 | 0.92 | 0.23 | 0.012 | 0.0034 | 0.030 | 0.02 | 0.05 | 0.01 | — | — | — |
| 3 | 0.08 | 0.87 | 0.22 | 0.013 | 0.0019 | 0.030 | 0.02 | 0.04 | 0.01 | — | — | — |
| 4 | 0.08 | 0.90 | 0.23 | 0.009 | 0.0011 | 0.030 | 0.02 | 0.05 | 0.01 | — | — | — |
| 5 | 0.08 | 0.89 | 0.22 | 0.011 | 0.0010 | 0.061 | 0.02 | 0.05 | 0.01 | — | — | — |
| 6 | 0.08 | 0.90 | 0.23 | 0.009 | 0.0011 | 0.030 | 0.15 | 0.05 | 0.15 | — | — | — |
| 7 | 0.07 | 0.92 | 0.20 | 0.010 | 0.0033 | 0.027 | 0.02 | 0.1 | 0.01 | — | — | — |
| 8 | 0.08 | 0.93 | 0.19 | 0.011 | 0.0048 | 0.028 | 0.02 | 0.07 | 0.01 | — | — | — |
| 9 | 0.08 | 0.90 | 0.21 | 0.009 | 0.0046 | 0.028 | 0.02 | 0.2 | 0.01 | — | — | — |
| 10 | 0.08 | 0.91 | 0.22 | 0.010 | 0.0012 | 0.030 | 0.02 | 0.07 | 0.01 | — | — | — |
| 11 | 0.07 | 0.92 | 0.23 | 0.011 | 0.0021 | 0.031 | 0.02 | 0.5 | 0.01 | — | — | — |

TABLE 1-continued

| | | | | | | | | | | | | |
|---|---|---|---|---|---|---|---|---|---|---|---|---|
| 12 | 0.08 | 0.88 | 0.20 | 0.009 | 0.0010 | 0.029 | 0.02 | 0.03 | 0.01 | — | — | — |
| 13 | 0.08 | 0.91 | 0.21 | 0.012 | 0.0011 | 0.020 | 0.02 | 0.2 | 0.01 | — | — | — |
| 14 | 0.08 | 0.93 | 0.20 | 0.011 | 0.0021 | 0.030 | 0.02 | 0.2 | 0.01 | — | — | — |
| 15 | 0.08 | 0.90 | 0.21 | 0.009 | 0.0011 | 0.027 | 0.02 | 0.1 | 0.01 | — | — | — |
| 16 | 0.08 | 0.89 | 0.23 | 0.010 | 0.0021 | 0.030 | 0.02 | 0.1 | 0.01 | — | — | — |
| 17 | 0.08 | 0.89 | 0.22 | 0.011 | 0.0011 | 0.030 | 0.02 | 0.1 | 0.01 | 0.1 | — | — |
| 18 | 0.08 | 0.90 | 0.22 | 0.011 | 0.0010 | 0.030 | 0.02 | 0.1 | 0.01 | — | 0.1 | — |
| 19 | 0.08 | 0.87 | 0.22 | 0.010 | 0.0032 | 0.030 | 0.02 | 0.1 | 0.01 | 0.1 | 0.1 | — |
| 20 | 0.07 | 0.91 | 0.23 | 0.011 | 0.0011 | 0.030 | 0.02 | 0.2 | 0.01 | 0.1 | 0.1 | — |
| 21 | 0.08 | 0.89 | 0.21 | 0.009 | 0.0012 | 0.029 | 0.02 | 0.1 | 0.01 | — | — | 0.002 |
| 22 | 0.08 | 0.88 | 0.20 | 0.010 | 0.0020 | 0.030 | 0.02 | 0.5 | 0.02 | — | — | — |
| 23 | 0.08 | 0.90 | 0.20 | 0.011 | 0.0011 | 0.030 | 0.02 | 0.1 | 0.02 | — | — | — |
| 24 | 0.08 | 0.90 | 0.21 | 0.009 | 0.0012 | 0.028 | 0.02 | 0.2 | 0.02 | — | — | — |
| 25 | 0.08 | 0.91 | 0.23 | 0.010 | 0.0022 | 0.030 | 0.02 | 0.1 | 0.02 | — | — | — |
| 26 | 0.08 | 0.90 | 0.22 | 0.012 | 0.0011 | 0.031 | 0.02 | 0.1 | 0.02 | 0.05 | — | — |
| 27 | 0.08 | 0.90 | 0.22 | 0.010 | 0.0021 | 0.031 | 0.02 | 0.2 | 0.02 | — | — | 0.002 |
| 28 | 0.08 | 0.92 | 0.22 | 0.010 | 0.0036 | 0.029 | 0.02 | 0.05 | 0.02 | — | 0.05 | 0.001 |
| 29 | 0.08 | 0.92 | 0.21 | 0.009 | 0.0023 | 0.031 | 0.02 | — | 0.03 | — | — | — |
| 30 | 0.08 | 0.91 | 0.21 | 0.010 | 0.0053 | 0.028 | 0.02 | — | 0.03 | — | — | — |
| 31 | 0.08 | 0.89 | 0.22 | 0.012 | 0.0020 | 0.028 | 0.02 | — | 0.03 | — | — | — |
| 32 | 0.08 | 0.92 | 0.22 | 0.010 | 0.0024 | 0.030 | 0.02 | — | 0.03 | 0.08 | — | — |
| 33 | 0.07 | 0.91 | 0.21 | 0.011 | 0.0022 | 0.031 | 0.02 | 0.008 | 0.03 | — | — | — |
| 34 | 0.08 | 0.88 | 0.23 | 0.010 | 0.0052 | 0.003 | 0.004 | 0.04 | 0.008 | — | — | — |
| 35 | 0.08 | 0.91 | 0.20 | 0.011 | 0.0012 | 0.030 | 0.02 | — | 0.03 | — | — | — |
| 36 | 0.07 | 0.92 | 0.22 | 0.012 | 0.0013 | 0.030 | 0.02 | 0.008 | 0.03 | — | — | — |
| 37 | 0.08 | 0.92 | 0.19 | 0.010 | 0.0030 | 0.003 | 0.02 | 0.04 | 0.01 | — | — | — |
| 38 | 0.07 | 0.90 | 0.20 | 0.010 | 0.0033 | 0.028 | 0.004 | 0.04 | 0.01 | — | — | — |

| | Chemical composition (mass %) | | | | | | |
|---|---|---|---|---|---|---|---|
| No. | Nb | Zr | V | Ti | Sb/S ≥ 15 | Ni/Cu ≥ 0.2 | Remarks |
| 1 | — | — | — | — | Aplicable | Aplicable | Example 1 |
| 2 | — | — | — | — | Not Aplicable | Aplicable | Example 2 |
| 3 | — | — | — | — | Aplicable | Aplicable | Example 3 |
| 4 | — | — | — | — | Aplicable | Aplicable | Example 4 |
| 5 | — | — | — | — | Aplicable | Aplicable | Example 5 |
| 6 | — | — | — | — | Aplicable | Aplicable | Example 6 |
| 7 | — | — | — | — | Aplicable | Aplicable | Example 7 |
| 8 | — | — | — | — | Not Aplicable | Aplicable | Example 8 |
| 9 | — | — | — | — | Aplicable | Aplicable | Example 9 |
| 10 | — | — | — | — | Aplicable | Aplicable | Example 10 |
| 11 | — | — | — | — | Aplicable | Aplicable | Example 11 |
| 12 | — | — | — | — | Aplicable | Aplicable | Example 12 |
| 13 | — | — | — | — | Aplicable | Aplicable | Example 13 |
| 14 | — | — | — | — | Aplicable | Aplicable | Example 14 |
| 15 | — | — | — | — | Aplicable | Aplicable | Example 15 |
| 16 | — | — | — | — | Aplicable | Aplicable | Example 16 |
| 17 | — | — | — | — | Aplicable | Aplicable | Example 17 |
| 18 | — | — | — | — | Aplicable | Aplicable | Example 18 |
| 19 | — | — | — | — | Aplicable | Aplicable | Example 19 |
| 20 | — | — | — | — | Aplicable | Aplicable | Example 20 |
| 21 | — | — | — | — | Aplicable | Aplicable | Example 21 |
| 22 | 0.02 | — | — | — | Aplicable | Aplicable | Example 22 |
| 23 | — | 0.02 | — | — | Aplicable | Aplicable | Example 23 |
| 24 | — | — | 0.02 | — | Aplicable | Aplicable | Example 24 |
| 25 | — | — | — | 0.02 | Aplicable | Aplicable | Example 25 |
| 26 | — | — | 0.01 | — | Aplicable | Aplicable | Example 26 |
| 27 | 0.01 | — | — | 0.01 | Aplicable | Aplicable | Example 27 |
| 28 | — | — | — | — | Not Aplicable | Aplicable | Example 28 |
| 29 | — | — | — | — | Not Aplicable | Aplicable | Comparative Example 1 |
| 30 | — | — | — | — | Not Aplicable | Aplicable | Comparative Example 2 |
| 31 | — | — | 0.02 | — | Not Aplicable | Aplicable | Comparative Example 3 |
| 32 | — | — | — | — | Not Aplicable | Aplicable | Comparative Example 4 |
| 33 | — | — | — | — | Not Aplicable | Aplicable | Comparative Example 5 |
| 34 | — | — | — | — | Not Aplicable | Aplicable | Comparative Example 6 |
| 35 | — | — | — | — | Not Aplicable | Aplicable | Comparative Example 7 |
| 36 | — | — | — | — | Not Aplicable | Aplicable | Comparative Example 8 |
| 37 | — | — | — | — | Not Aplicable | Aplicable | Comparative Example 9 |
| 38 | — | — | — | — | Not Aplicable | Aplicable | Comparative Example 10 |

TABLE 2

| No. | Maximum pitting corrosion depth ratio (with respect to Comparative Example 1, %) | SCC resistance | Remarks |
|---|---|---|---|
| 1 | 57.5 | Excellent | Example 1 |
| 2 | 66.9 | Good | Example 2 |
| 3 | 58.3 | Excellent | Example 3 |
| 4 | 54.1 | Excellent | Example 4 |
| 5 | 47.3 | Excellent | Example 5 |
| 6 | 48.0 | Excellent | Example 6 |
| 7 | 43.5 | Excellent | Example 7 |
| 8 | 68.0 | Good | Example 8 |
| 9 | 49.1 | Excellent | Example 9 |
| 10 | 46.4 | Excellent | Example 10 |
| 11 | 28.2 | Excellent | Example 11 |
| 12 | 59.4 | Excellent | Example 12 |
| 13 | 29.6 | Excellent | Example 13 |
| 14 | 33.3 | Excellent | Example 14 |
| 15 | 32.0 | Excellent | Example 15 |
| 16 | 39.6 | Excellent | Example 16 |
| 17 | 30.0 | Excellent | Example 17 |
| 18 | 31.1 | Excellent | Example 18 |
| 19 | 35.9 | Excellent | Example 19 |
| 20 | 22.8 | Excellent | Example 20 |
| 21 | 32.5 | Excellent | Example 21 |
| 22 | 28.7 | Excellent | Example 22 |
| 23 | 31.3 | Excellent | Example 23 |
| 24 | 26.4 | Excellent | Example 24 |
| 25 | 36.2 | Excellent | Example 25 |
| 26 | 29.9 | Excellent | Example 26 |
| 27 | 33.6 | Excellent | Example 27 |
| 28 | 64.0 | Good | Example 28 |
| 29 | 100.0 | Poor | Comparative Example 1 |
| 30 | 126.4 | Poor | Comparative Example 2 |
| 31 | 101.5 | Poor | Comparative Example 3 |
| 32 | 94.6 | Poor | Comparative Example 4 |
| 33 | 89.3 | Fair | Comparative Example 5 |
| 34 | 88.2 | Fair | Comparative Example 6 |
| 35 | 78.4 | Fair | Comparative Example 7 |
| 36 | 73.9 | Fair | Comparative Example 8 |
| 37 | 85.5 | Fair | Comparative Example 9 |
| 38 | 82.9 | Fair | Comparative Example 10 |

As is clear from Table 2, in all examples, pitting corrosion in the bioethanol simulated liquid was suppressed, and the SCC resistance was significantly improved.

In all comparative examples with the chemical compositions not within the disclosed range, on the other hand, the pitting corrosion depth was large, and the SCC resistance was not significantly improved.

The improvement effects of the disclosed steel materials are clear from the comparison between the examples and the comparative examples.

The invention claimed is:

1. A steel material having a chemical composition comprising, by mass%:

0.03% to 0.3% C;
0.03% to 1.0% Si;
0.1% to 2.0% Mn;
0.003% to 0.03% P;
0.005% or less S;
0.005% to 0.1% Al;
0.005% to 0.5% Cu;
0.03% to 0.5% Sb; and
0.005% to 0.5% Ni,
with a balance being Fe and incidental impurities,
wherein the Sb content and the S content satisfy $Sb/S \geq 15$, and the Ni content and the Cu content satisfy $Ni/Cu \geq 0.2$.

2. The steel material according to claim 1, wherein the chemical composition further comprises, by mass %, at least one selected from the group consisting of 0.01% to 0.5% Mo, 0.01% to 0.5% W, 0.01% or less Ca, 0.005% to 0.1% Nb, 0.005% to 0.1% Zr, 0.005% to 0.1% V and 0.005% to 0.1% Ti.

3. The steel material according to claim 1, wherein the composition comprises, by mass %, 0.001% to 0.005% S.

4. The steel material according to claim 3, wherein the composition comprises, by mass %, 0.03% to 0.30% Sb.

5. The steel material according to claim 3, wherein the Sb content and the S content satisfy $Sb/S \geq 20$ and $Sb/S \leq 300$.

* * * * *